US008069582B2

(12) United States Patent
Lee et al.

(10) Patent No.: US 8,069,582 B2
(45) Date of Patent: Dec. 6, 2011

(54) DRYER

(75) Inventors: Ju Dong Lee, Bupyeong-gu (KR); Chang Hoo Kim, Gyeyang-gu (KR)

(73) Assignee: Daewoo Electronics Corporation, Seoul (KR)

( * ) Notice: Subject to any disclaimer, the term of this patent is extended or adjusted under 35 U.S.C. 154(b) by 440 days.

(21) Appl. No.: 12/343,526

(22) Filed: Dec. 24, 2008

(65) Prior Publication Data

US 2009/0165323 A1 Jul. 2, 2009

(30) Foreign Application Priority Data

Dec. 27, 2007 (KR) ..... 10-2007-0139511
Dec. 27, 2007 (KR) ..... 10-2007-0139517

(51) Int. Cl.
*F26B 21/08* (2006.01)

(52) U.S. Cl. ..... 34/108; 34/601; 68/5 R

(58) Field of Classification Search ..... 34/90, 105, 34/108, 601, 602, 603, 610; 68/5 R
See application file for complete search history.

(56) References Cited

U.S. PATENT DOCUMENTS 1,794,909 A * 3/1931 Langsner ..... 34/88
1,882,703 A * 10/1932 Ames ..... 126/37 R
1,893,398 A * 1/1933 Chamberlin ..... 68/24
2,049,782 A * 8/1936 Smith ..... 62/106
2,069,278 A * 2/1937 Sackett ..... 236/15 A
2,140,408 A * 12/1938 Sherman ..... 126/37 R
2,243,390 A * 5/1941 Mercier ..... 432/32
2,284,880 A * 6/1942 Nicholson ..... 194/241
2,419,319 A * 4/1947 Lankton ..... 52/27
2,436,333 A * 2/1948 Root ..... 69/23
2,495,297 A * 1/1950 Stern ..... 356/344
2,503,330 A * 4/1950 Geldhof ..... 432/117
2,517,421 A * 8/1950 Geldhof ..... 432/117
2,603,205 A * 7/1952 Schueder ..... 126/110 B
RE23,653 E * 5/1953 Stern ..... 356/344
2,671,346 A * 3/1954 Banning, Jr. ..... 73/152.44
2,687,578 A * 8/1954 Richterkessing ..... 34/127
2,716,339 A * 8/1955 Cline ..... 73/116.06
2,716,820 A * 9/1955 Bourner ..... 34/82
2,758,461 A * 8/1956 Tann ..... 68/19.1
2,830,385 A * 4/1958 Smith ..... 34/601
2,834,121 A * 5/1958 Geldhof ..... 34/75
2,852,860 A * 9/1958 Stickle ..... 34/556
2,867,430 A * 1/1959 Hullar ..... 432/107
2,911,810 A * 11/1959 Lantz et al. ..... 68/12.15
2,929,556 A * 3/1960 Hawkins et al. ..... 710/65
2,929,674 A * 3/1960 Tann ..... 8/159
2,931,687 A * 4/1960 Mitter ..... 312/323
2,957,688 A * 10/1960 Luecke ..... 266/99
2,991,990 A * 7/1961 Mitter ..... 432/107

(Continued)

FOREIGN PATENT DOCUMENTS

DE 3841915 C1 * 5/1990

(Continued)

*Primary Examiner* — Stephen M. Gravini
(74) *Attorney, Agent, or Firm* — Occhiuti Rohlicek & Tsao LLP

(57) ABSTRACT

A dryer includes a cabinet; a drum rotatably mounted inside the cabinet; a front panel provided between the cabinet and the drum; a valve provided inside the cabinet to control supply and cutoff of gas and an amount of the supplied gas; a fixing piece for mounting the valve on one side thereof; and a bracket coupled to the other side of the fixing piece.

10 Claims, 10 Drawing Sheets

U.S. PATENT DOCUMENTS 3,038,324 A * 6/1962 Hubbard ..... 68/19.2
3,051,554 A * 8/1962 Butts et al. ..... 264/142
3,078,702 A * 2/1963 Conlee ..... 68/20
3,160,993 A * 12/1964 McCormick, Jr. ..... 451/38
3,168,412 A * 2/1965 Wald, Jr. et al. ..... 427/163.4
3,183,856 A * 5/1965 Jolly ..... 99/450.4
3,192,915 A * 7/1965 Norris et al. ..... 124/77
3,245,194 A * 4/1966 Carski ..... 53/432
3,270,529 A * 9/1966 Engel ..... 68/18 F
3,290,895 A * 12/1966 Schneider et al. ..... 62/298
3,304,909 A * 2/1967 Hart et al. ..... 118/103
3,306,835 A * 2/1967 Magnus ..... 204/157.62
3,363,326 A * 1/1968 Weeks ..... 34/528
3,385,085 A * 5/1968 Engel ..... 68/18 F
3,385,962 A * 5/1968 Freeman ..... 362/262
3,491,543 A * 1/1970 Crosby ..... 62/72
3,524,784 A * 8/1970 Isaksson et al. ..... 156/367
3,608,608 A * 9/1971 Field ..... 159/1.1
3,698,214 A * 10/1972 Bahnsen ..... 68/205 R
3,709,732 A * 1/1973 Thomen ..... 134/57 D
3,794,803 A * 2/1974 Valdeck ..... 219/61
3,867,999 A * 2/1975 Cox ..... 184/1.5
4,086,053 A * 4/1978 Sommer, Jr. ..... 432/222
4,300,443 A * 11/1981 Morcos et al. ..... 99/332
4,319,856 A * 3/1982 Jeppson ..... 404/79
4,526,535 A * 7/1985 Wunderlich ..... 432/105
4,591,967 A * 5/1986 Mattes et al. ..... 700/3
4,712,653 A * 12/1987 Franklin et al. ..... 187/269
4,953,365 A * 9/1990 Lang et al. ..... 62/381
5,010,761 A * 4/1991 Cohen et al. ..... 73/40.7
5,020,330 A * 6/1991 Rhoades et al. ..... 62/63
5,143,102 A * 9/1992 Blaul ..... 134/58 R
5,174,384 A * 12/1992 Herman ..... 169/70
5,401,973 A * 3/1995 McKeown et al. ..... 250/492.3
5,434,420 A * 7/1995 McKeown et al. ..... 250/396 R
5,451,794 A * 9/1995 McKeown et al. ..... 250/492.3
5,551,909 A * 9/1996 Bailey ..... 451/75
5,585,143 A * 12/1996 Scharf et al. ..... 427/224
5,676,588 A * 10/1997 Frederick et al. ..... 451/86
5,921,102 A * 7/1999 Vago ..... 62/337
6,099,882 A * 8/2000 Risner et al. ..... 426/314
6,164,344 A * 12/2000 Nickens et al. ..... 141/51
6,219,113 B1 * 4/2001 Takahara ..... 349/42
6,308,748 B1 * 10/2001 Nickens et al. ..... 141/51
6,628,355 B1 * 9/2003 Takahara ..... 349/106
7,005,612 B2 * 2/2006 Han ..... 219/270
7,140,405 B2 * 11/2006 Lewis et al. ..... 141/104
7,435,390 B2 * 10/2008 Cracauer et al. ..... 422/130
7,530,373 B2 * 5/2009 Lewis et al. ..... 141/9
7,610,113 B2 * 10/2009 Cocciadiferro et al. ..... 700/108
7,790,393 B2 * 9/2010 Lyamichev et al. ..... 435/6
7,895,770 B2 * 3/2011 Bae et al. ..... 34/595
2002/0017117 A1 * 2/2002 Sunshine et al. ..... 68/3 R
2002/0083944 A1 * 7/2002 Darbonne, Sr. ..... 126/501
2002/0142454 A1 * 10/2002 Cracauer et al. ..... 435/287.2
2002/0156255 A1 * 10/2002 Cracauer ..... 536/23.1
2003/0082544 A1 * 5/2003 Fors et al. ..... 435/6
2003/0104470 A1 * 6/2003 Fors et al. ..... 435/7.1
2003/0226561 A1 * 12/2003 Darbonne, Sr. ..... 126/501
2004/0014067 A1 * 1/2004 Lyamichev et al. ..... 435/6
2004/0134093 A1 * 7/2004 Han ..... 34/595
2004/0134237 A1 * 7/2004 Sunshine et al. ..... 68/3 R
2004/0261887 A1 * 12/2004 Lewis et al. ..... 141/1
2004/0264295 A1 * 12/2004 Lewis et al. ..... 366/160.2
2005/0010323 A1 * 1/2005 Cocciadiferro et al. ..... 700/174
2005/0115248 A1 * 6/2005 Koehler et al. ..... 62/53.1
2005/0201673 A1 * 9/2005 Ellwood, Jr. ..... 385/17
2005/0201674 A1 * 9/2005 Ellwood, Jr. ..... 385/17
2005/0201715 A1 * 9/2005 Ellwood, Jr. ..... 385/147
2006/0041448 A1 * 2/2006 Patterson et al. ..... 705/1
2006/0160074 A1 * 7/2006 Dorn et al. ..... 435/6
2006/0260488 A1 * 11/2006 Westby ..... 101/424
2007/0061393 A1 * 3/2007 Moore ..... 709/201
2007/0106536 A1 * 5/2007 Moore ..... 705/3
2007/0106537 A1 * 5/2007 Moore ..... 705/3
2007/0106750 A1 * 5/2007 Moore ..... 709/217
2007/0106751 A1 * 5/2007 Moore ..... 709/217
2007/0106752 A1 * 5/2007 Moore ..... 709/217
2007/0106753 A1 * 5/2007 Moore ..... 709/217
2007/0106754 A1 * 5/2007 Moore ..... 709/217
2007/0116036 A1 * 5/2007 Moore ..... 370/462
2007/0116037 A1 * 5/2007 Moore ..... 370/462
2007/0168461 A1 * 7/2007 Moore ..... 709/217
2007/0178474 A1 * 8/2007 Cracauer et al. ..... 435/6
2008/0022551 A1 * 1/2008 Banta et al. ..... 34/602
2008/0040151 A1 * 2/2008 Moore ..... 705/2
2008/0141558 A1 * 6/2008 Bae et al. ..... 34/595
2008/0149141 A1 * 6/2008 Sales ..... 134/22.1
2008/0261220 A1 * 10/2008 Cracauer et al. ..... 435/6
2008/0271263 A1 * 11/2008 Bae et al. ..... 8/159
2008/0276660 A1 * 11/2008 Bae et al. ..... 68/5 C
2009/0041634 A1 * 2/2009 Cracauer et al. ..... 422/135
2009/0068664 A1 * 3/2009 Lyamichev et al. ..... 435/6
2009/0165321 A1 * 7/2009 Kim ..... 34/72
2009/0165323 A1 * 7/2009 Lee et al. ..... 34/108
2009/0165324 A1 * 7/2009 Kim ..... 34/132
2009/0170048 A1 * 7/2009 Kim ..... 432/219
2009/0172773 A1 * 7/2009 Moore ..... 726/1
2009/0238811 A1 * 9/2009 McDaniel et al. ..... 424/94.2
2009/0278070 A1 * 11/2009 Kim ..... 251/324
2009/0287358 A1 * 11/2009 Lewis et al. ..... 700/285
2009/0293733 A1 * 12/2009 Martin et al. ..... 99/280
2009/0307922 A1 * 12/2009 Kim ..... 34/86
2009/0320317 A1 * 12/2009 Bae et al. ..... 34/282
2010/0024243 A1 * 2/2010 Ricklefs et al. ..... 34/474
2010/0028134 A1 * 2/2010 Slapak et al. ..... 415/119
2010/0031977 A1 * 2/2010 Sales ..... 134/39
2010/0192404 A1 * 8/2010 Maltese et al. ..... 34/524
2010/0192405 A1 * 8/2010 Rosca ..... 34/572
2010/0206016 A1 * 8/2010 Bae et al. ..... 68/5 C
2010/0210745 A1 * 8/2010 McDaniel et al. ..... 521/55
2010/0216946 A1 * 8/2010 Takahashi et al. ..... 525/183
2010/0233146 A1 * 9/2010 McDaniel ..... 424/94.2
2011/0049992 A1 * 3/2011 Sant'Anselmo et al. ..... 307/64
2011/0099834 A1 * 5/2011 Brown ..... 34/132

FOREIGN PATENT DOCUMENTS

EP 312741 A2 * 4/1989
EP 659937 A1 * 6/1995
EP 2072659 A1 * 6/2009
FR 2921355 A1 * 3/2009
GB 186701930 A * 12/1867
GB 2457518 A * 8/2009
GB 2458975 A * 10/2009
JP 54112378 A * 9/1979
JP 55015654 A * 2/1980
JP 55024250 A * 2/1980
JP 55031770 A * 3/1980
JP 55070848 A * 5/1980
JP 55087154 A * 7/1980
JP 55148343 A * 11/1980
JP 56059846 A * 5/1981
JP 56129201 A * 10/1981
JP 57045301 A * 3/1982
JP 57200484 A * 12/1982
WO WO 9848632 A1 * 11/1998

* cited by examiner

DRYER

CROSS-REFERENCE TO RELATED APPLICATIONS

The present application claims priority to Korean patent application number 10-2007-0139511, filed on Dec. 27, 2007 and 10-2007-0139517, filed on Dec. 27, 2007, which are incorporated by reference in its entirety.

BACKGROUND OF THE INVENTION

The present invention relates to a dryer, and more particularly, to a dryer with improved assemblage and easy repairing and replacing workability.

FIG. 1 is a schematic diagram showing a flow path of a conventional dryer and FIG. 2 is a partially broken perspective view of the conventional dryer.

Referring to FIGS. 1 and 2, the conventional dryer includes a cabinet 2 which forms an external appearance of the dryer and provided with an opening formed in front thereof and through which laundries to be dried are put into the dryer, a drum 12 which is rotatably mounted inside the cabinet 2 to accommodate the laundries to be dried and has opened front and rear portions for allowing air to pass therethrough, a heater 18 which is disposed inside the cabinet 2 to heat the air sucked into the cabinet 2, an intake duct 20 which guides the heated air passed through the heater 18 to the rear of the drum 12, an exhaust unit 22 which exhausts the air polluted by drying the laundries to the outside of the cabinet 2, a blower fan (not shown) which is installed in the exhaust unit 22, and a motor (not shown) and a belt 40 which drive the drum 12 and the blow fan to be rotated.

A lifter 11 is mounted on an inner peripheral surface of the drum 12 to lift up and drop the laundries to be dried.

The exhaust unit 22 includes a lint duct 25 which receives the air from the drum 12 to filter foreign substances from the air by a filter 24 mounted therein, a fan housing 26 which communicates with the lint duct 25 and houses the blower fan and an exhaust duct 27 which communicates with the fan housing 26 at one end thereof and extends to the outside of the cabinet 2 at the other end.

Operation of the conventional dryer having the above described structure will be described.

First, by operating the dryer after putting the laundries to be dried into the drum 12 and closing a door (not shown), the motor is driven to rotate the drum 12 and the blower fan and the heater 18 is operated together.

At this time, as the drum 12 is rotated, the laundries to be dried in the drum 12 are lifted up and dropped by the lifter 11.

External air is sucked in the heater 18, heated to air with high temperature and low humidity and then supplied to the inside of the drum 12 through the intake duct 20.

The air with high temperature and low humidity supplied to the inside of the drum 12 is brought into direct contact with the laundries to dry the laundries and changed to air with low temperature and high humidity. While drying the laundries, the air is moved toward the front of the drum 12 and then exhausted to the outside of the dryer through the exhaust unit 22.

In the conventional dryer, it is not easy to assemble a valve for controlling injection and cutoff of gas and an amount of the injected gas, and replacement of the valve is complex since a front panel should be disassembled in order to replace the valve. Therefore, it is required to improve the problems.

SUMMARY OF THE INVENTION

In the conventional dryer, it is not easy to assemble a valve for controlling injection and cutoff of gas and an amount of the injected gas, and replacement of the valve is complex since a front panel should be disassembled in order to replace the valve.

Therefore, it is required to improve the problems.

Embodiments of the present invention are directed to a dryer with improved assemblage and easy repairing and replacing workability.

In one embodiment, a dryer includes a cabinet; a drum rotatably mounted inside the cabinet; a front panel provided between the cabinet and the drum; a valve provided inside the cabinet to control supply and cutoff of gas and an amount of the supplied gas; a fixing piece for mounting the valve on one side thereof; and a bracket coupled to the other side of the fixing piece.

Preferably, the bracket is provided with a projection which corresponds to a through hole part of the fixing piece.

Preferably, the fixing part includes a bended panel having a '⌉'shape.

More preferably, the valve is mounted on an upper face of the fixing piece and the bracket is coupled to a side face of the fixing piece.

More preferably, the side face of the fixing piece is formed with a through hole part and the bracket is formed with a fastening hole part which corresponds to the through hole part.

Preferably, the front panel is provided with a service hole part.

More preferably, the service hole part is formed so as to corresponding to a position at which the valve is installed.

In another embodiment, a dryer includes a cabinet; a drum rotatably mounted inside the cabinet; a front panel provided between the cabinet and the drum; a valve provided inside the cabinet to control supply and cutoff of gas and an amount of the supplied gas; a fixing piece for mounting the valve on one side thereof; and a bracket slidingly mounted to the other side of the fixing piece.

Preferably, the bracket is provided with a guide into which the fixing piece is slidingly inserted; and a support piece disposed at a lower side of the guide to support the fixing piece.

Preferably, the fixing part includes a bended panel having a '⌉'shape.

Preferably, the valve is mounted on an upper face of the fixing piece and the bracket is coupled to a side face of the fixing piece.

More preferably, the side face of the fixing piece is formed with a through hole part and the bracket is formed with a fastening hole part which corresponds to the through hole part.

Preferably, the front panel is provided with a service hole part.

More preferably, the service hole part is formed so as to corresponding to a position at which the valve is installed.

According to the present invention, since the fixing piece for mounting the valve is provided, it is possible to perform control, repair or replacement of the valve without separation of the front panel upon the control, repair or replacement of the valve and thus reduce time and cost taken for the operation.

Also, since the front panel is provided with the service hole part, it is possible to perform control, repair or replacement of the valve without separation of the front panel upon the control, repair or replacement of the valve and thus reduce time and cost taken for the operation.

DESCRIPTION OF SPECIFIC EMBODIMENTS

Hereinafter, an exemplary embodiment of the present invention will be described with reference to accompanying drawings.

For convenience of description, a dryer provided with a gas heater will be described by way of example.

It should be noted that the drawings are not to precise scale and may be exaggerated in thickness of lines or size of components for the purpose of convenience and clarity only.

Furthermore, terms used herein are defined in consideration of functions in the present invention and can be changed according to the custom or intention of users or operators.

Thus, definition of such terms should be determined according to overall disclosures set forth herein.

Figure 1:
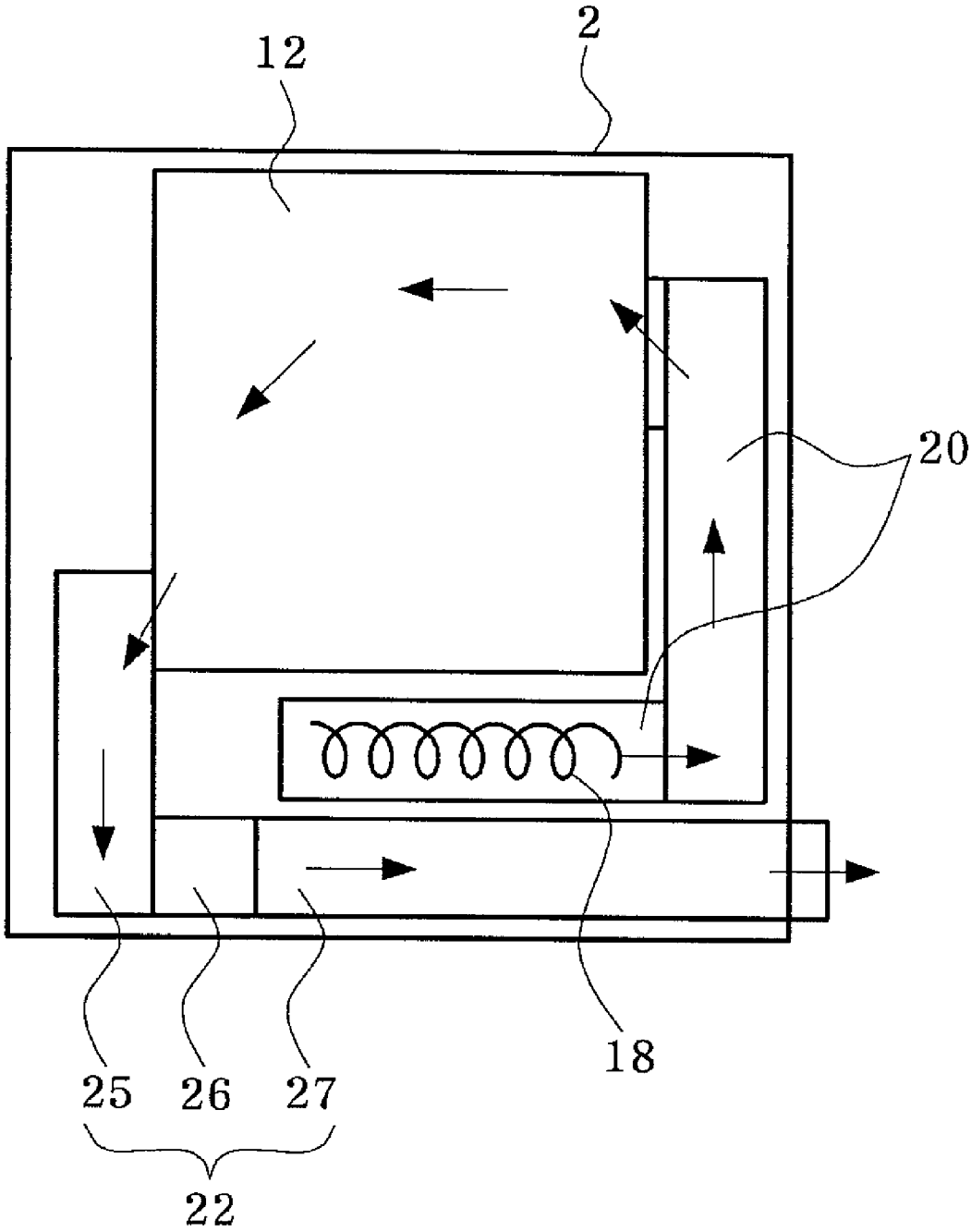
Fig. 1 Prior Art
FIG. 1 is a schematic diagram showing a flow path of a conventional dryer.
Figure 2:
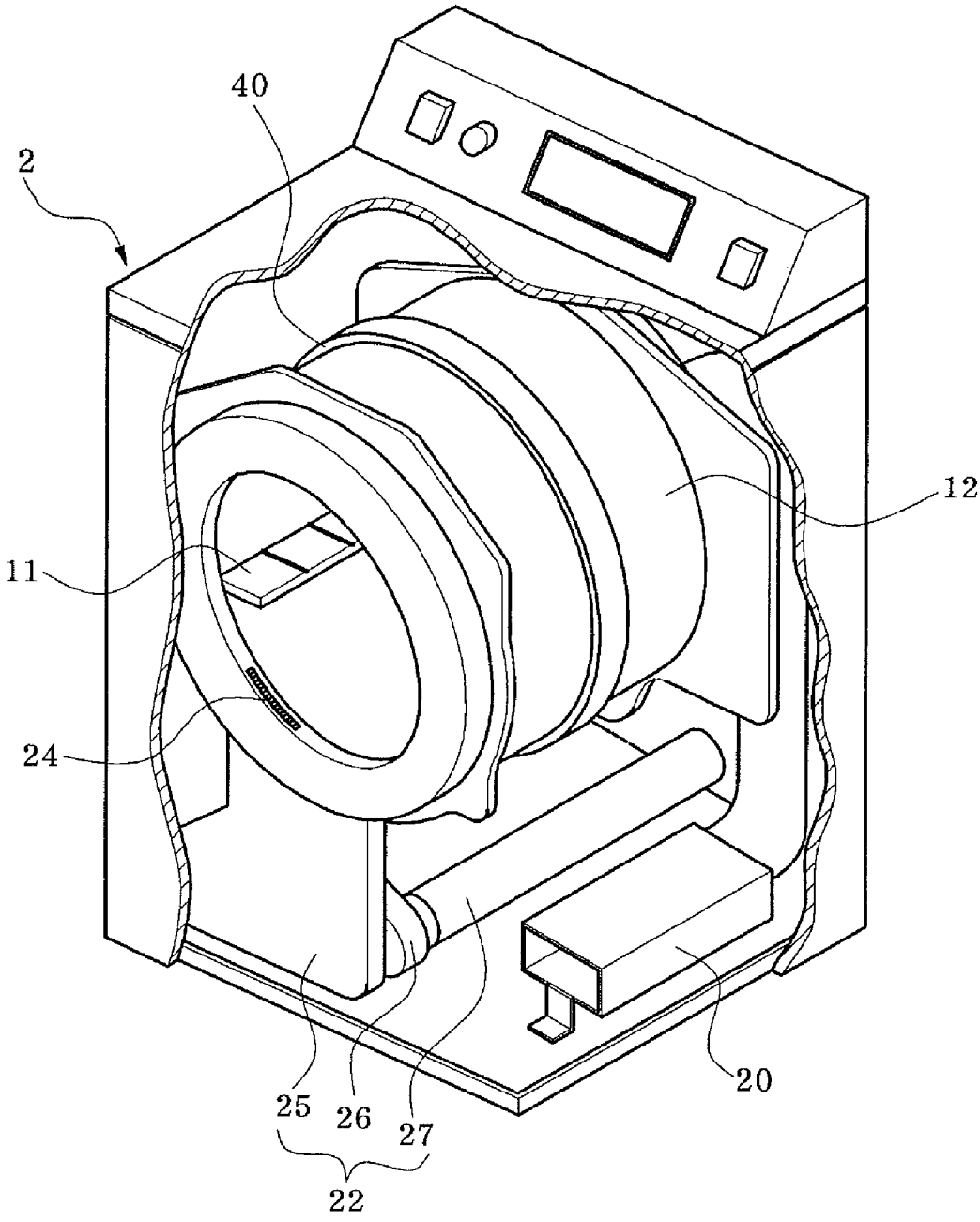
Fig. 2 Prior Art
FIG. 2 is a partially broken perspective view of the conventional dryer.
Figure 3:
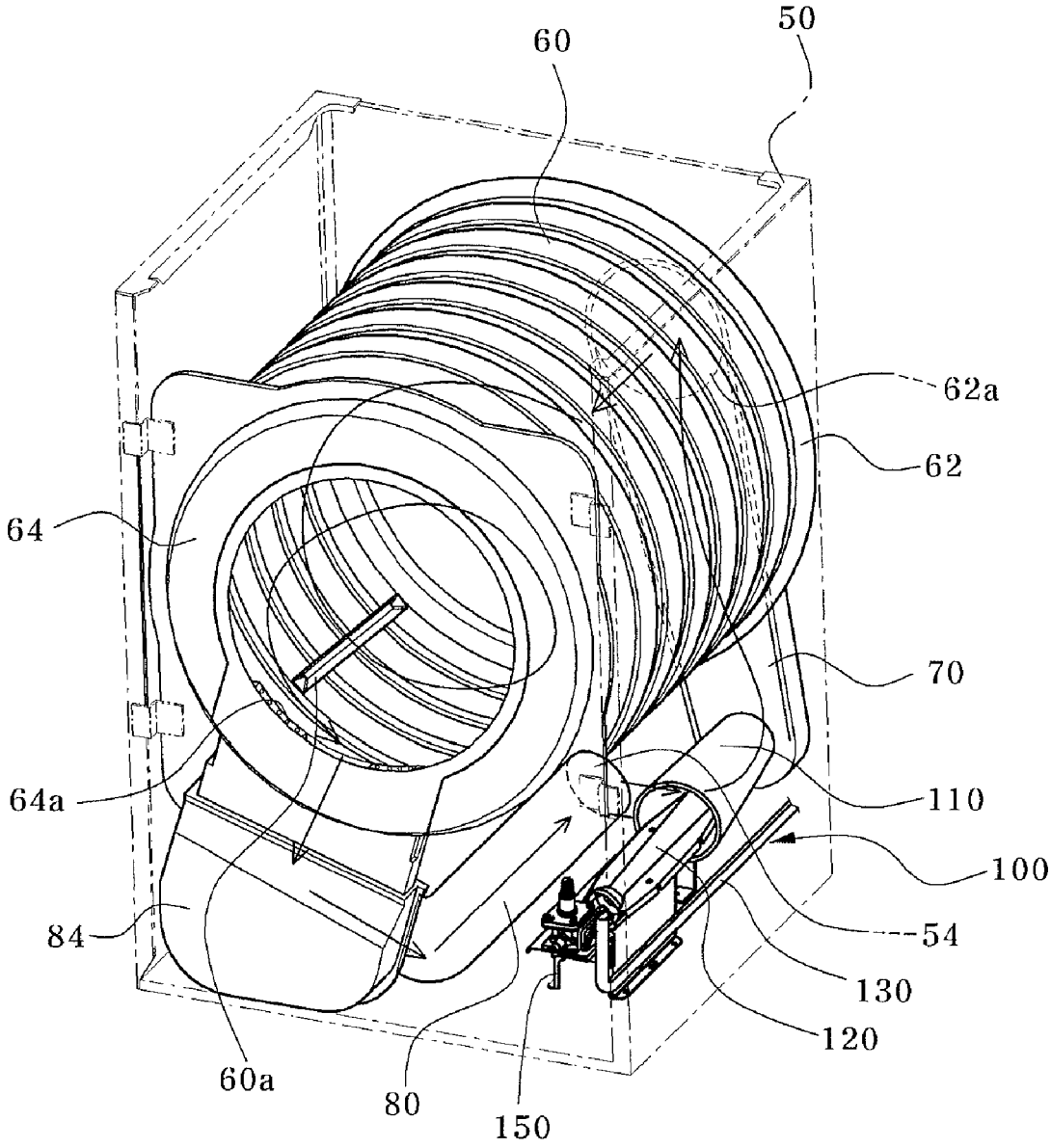
FIG. 3 is a structural view illustrating a dryer in accordance with an embodiment of the present invention.
Figure 4:
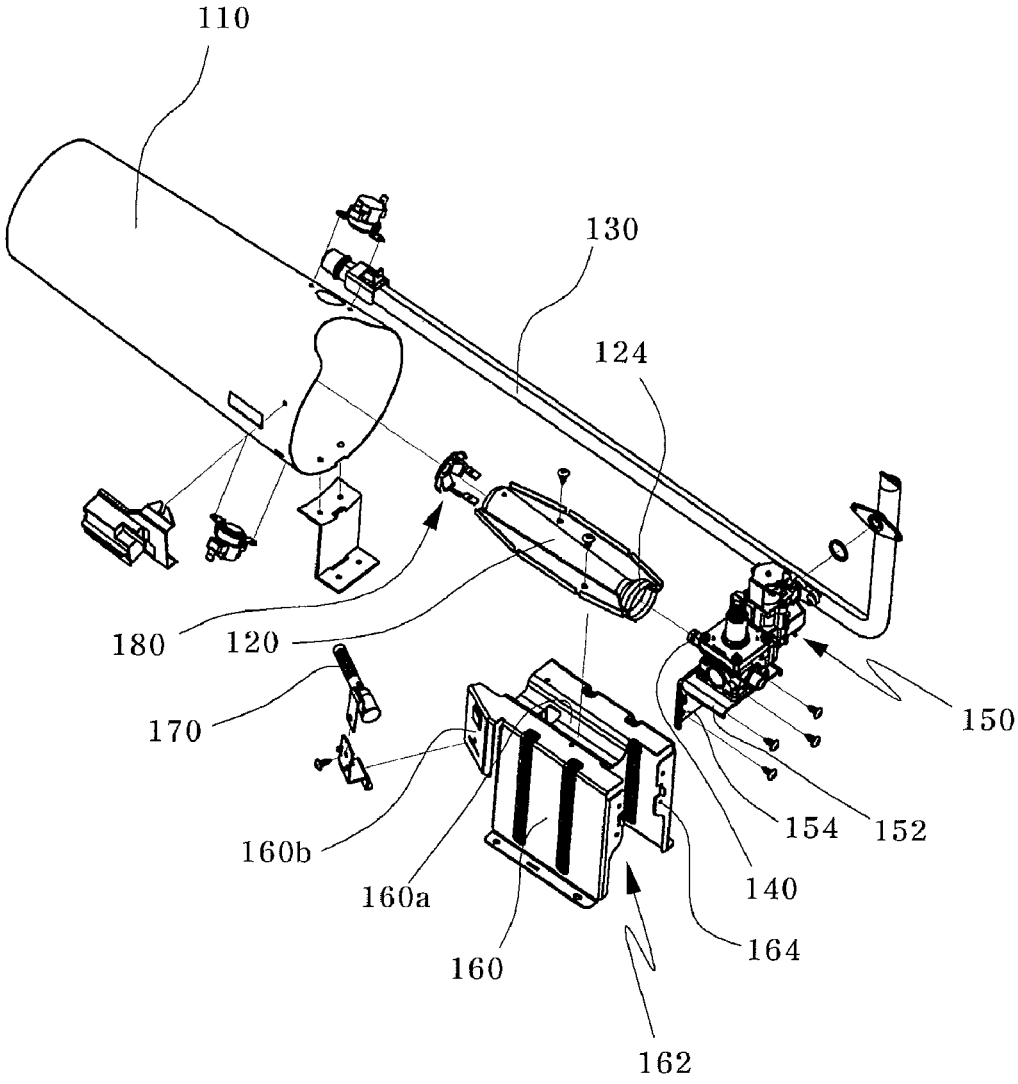
FIG. 4 is an exploded perspective view illustrating a gas heater of the dryer in accordance with an embodiment of the present invention.
Figure 5:
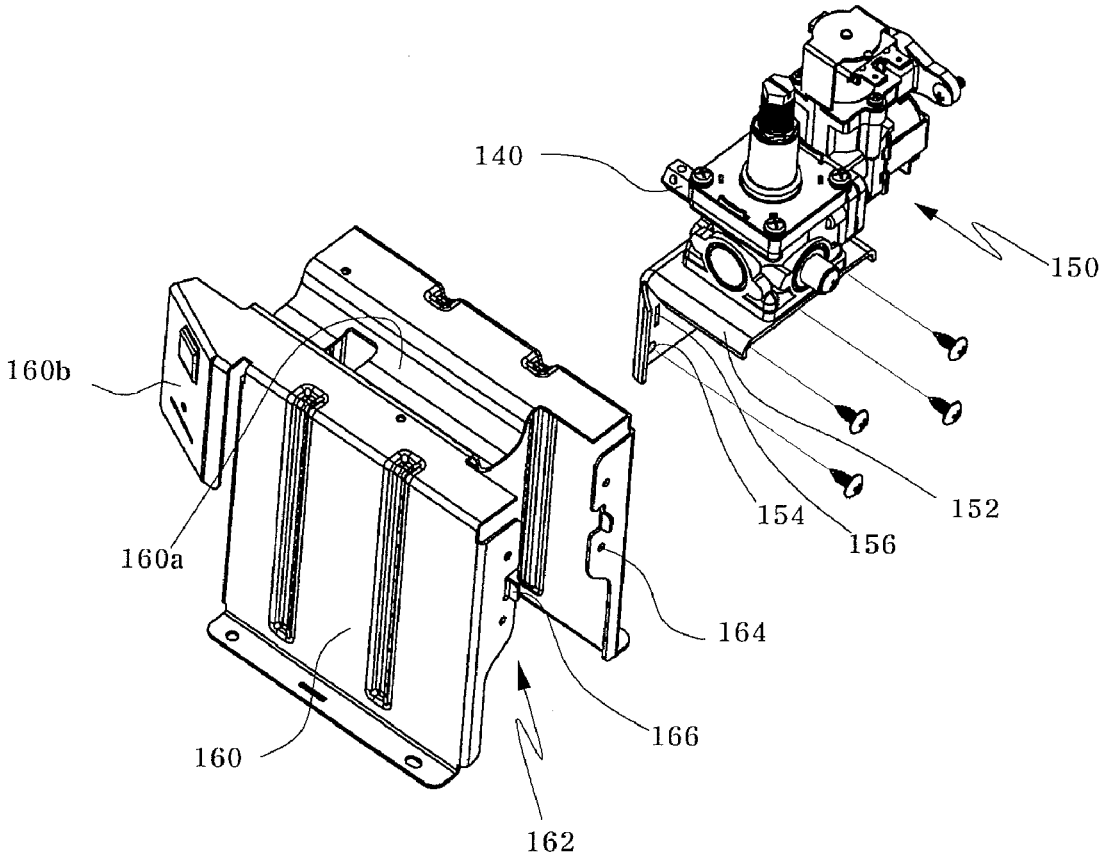
FIG. 5 is a perspective view illustrating a bracket of the gas heater of the dryer in accordance with an embodiment of the present invention.

FIG. 3 is a structural view illustrating a dry in accordance with an embodiment of the present invention; FIG. 4 is an exploded perspective view illustrating a gas heater of the dryer in accordance with an embodiment of the present invention; and FIG. 5 is a perspective view illustrating a bracket of the gas heater of the dryer in accordance with an embodiment of the present invention.

Figure 6:
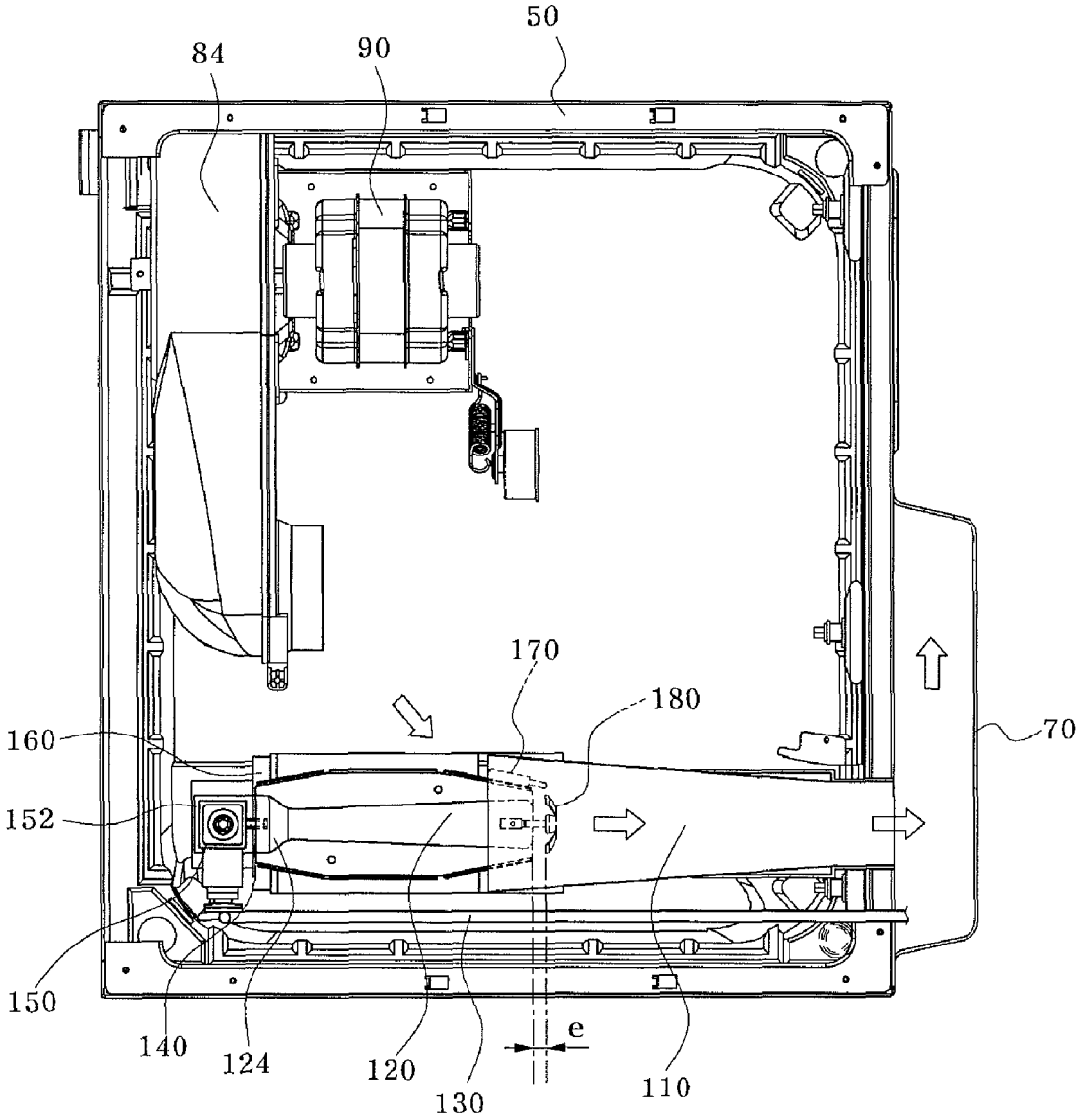
FIG. 6 is a plan view illustrating an intake flow path of the dryer in accordance with an embodiment of the present invention.
Figure 7:
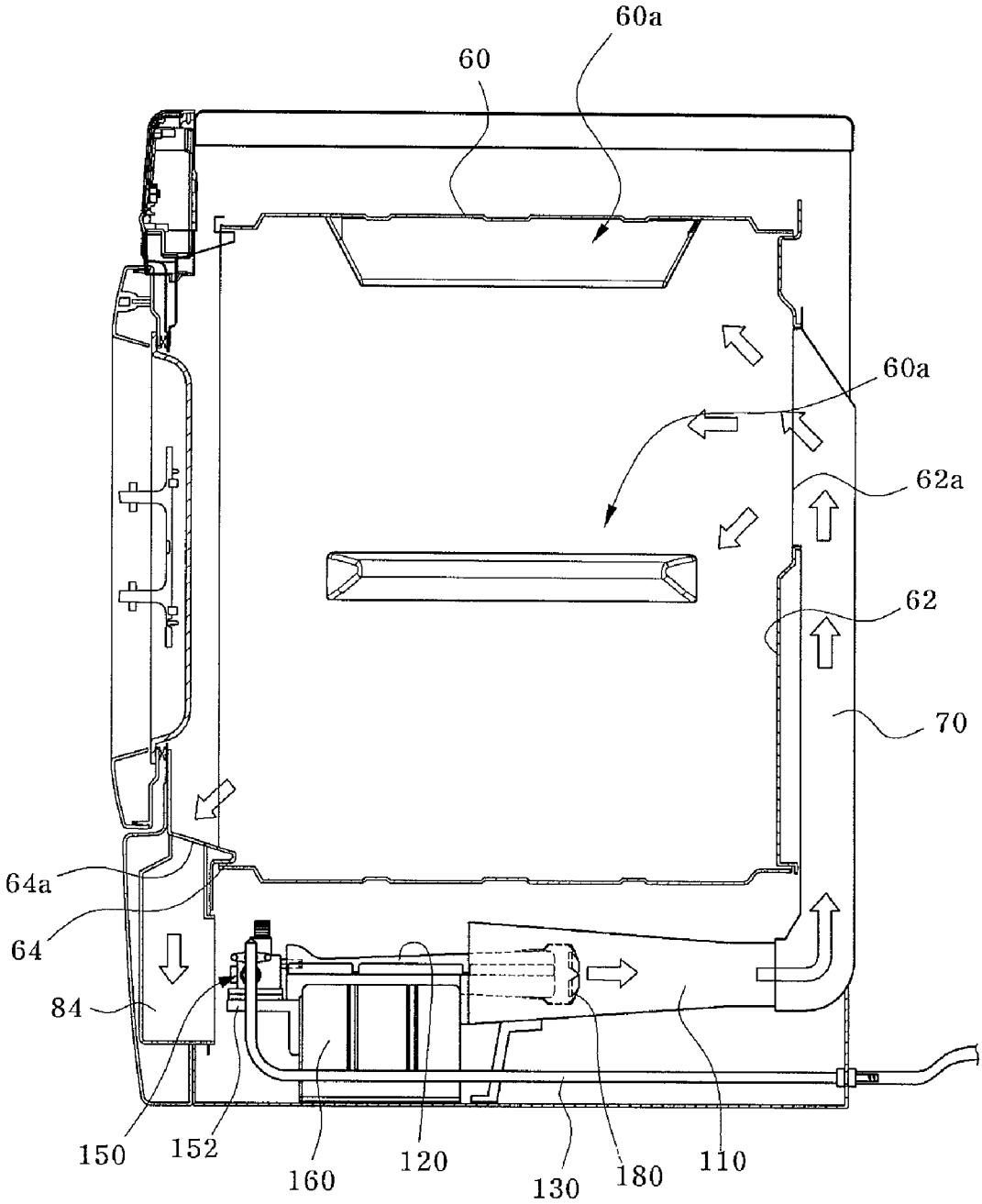
FIG. 7 is a side sectional view illustrating a circulation flow path of the dryer in accordance with an embodiment of the present invention.
Figure 8:
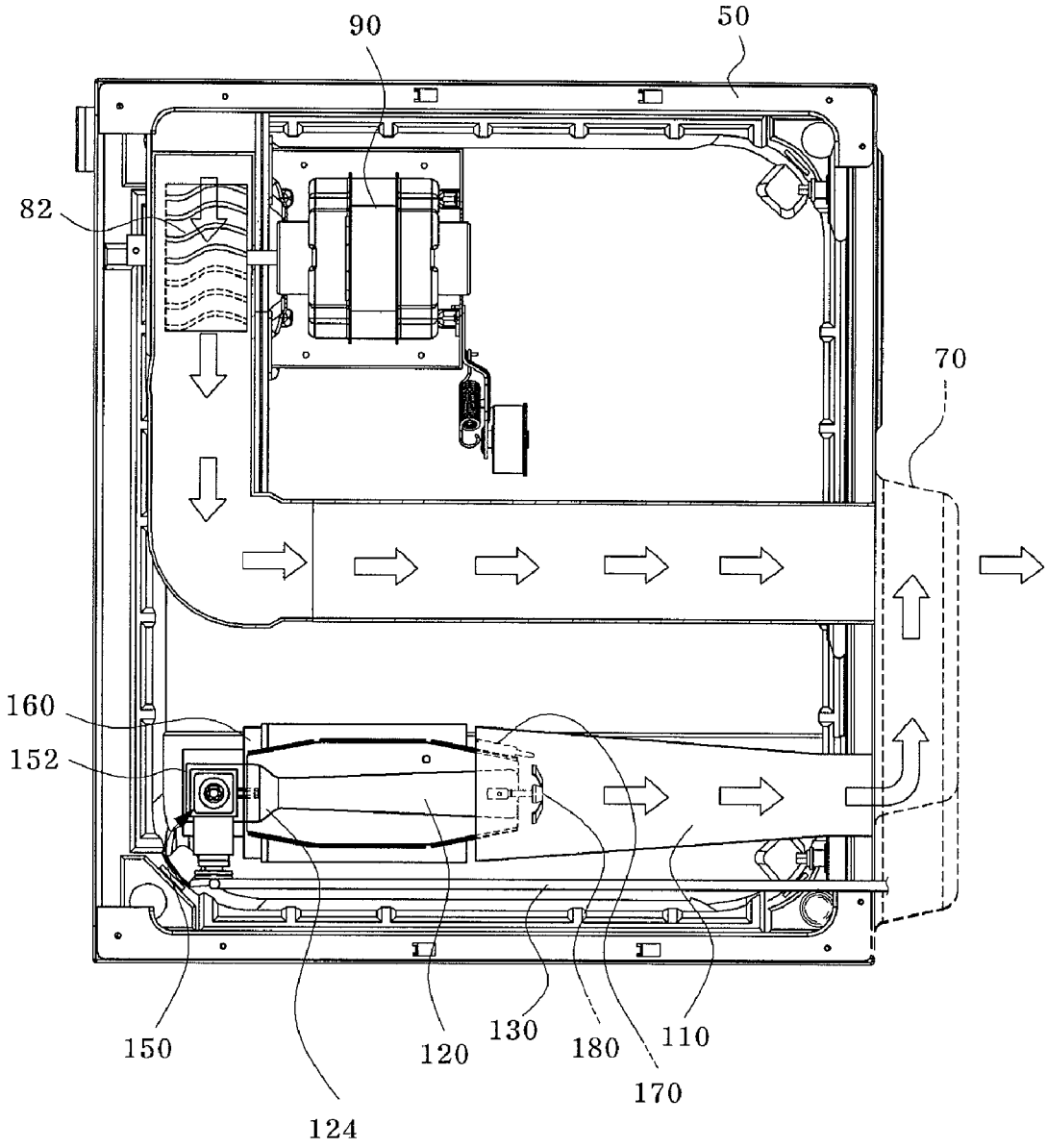
FIG. 8 is a plan view illustrating an exhaust flow path of the dryer in accordance with an embodiment of the present invention.
Figure 9:
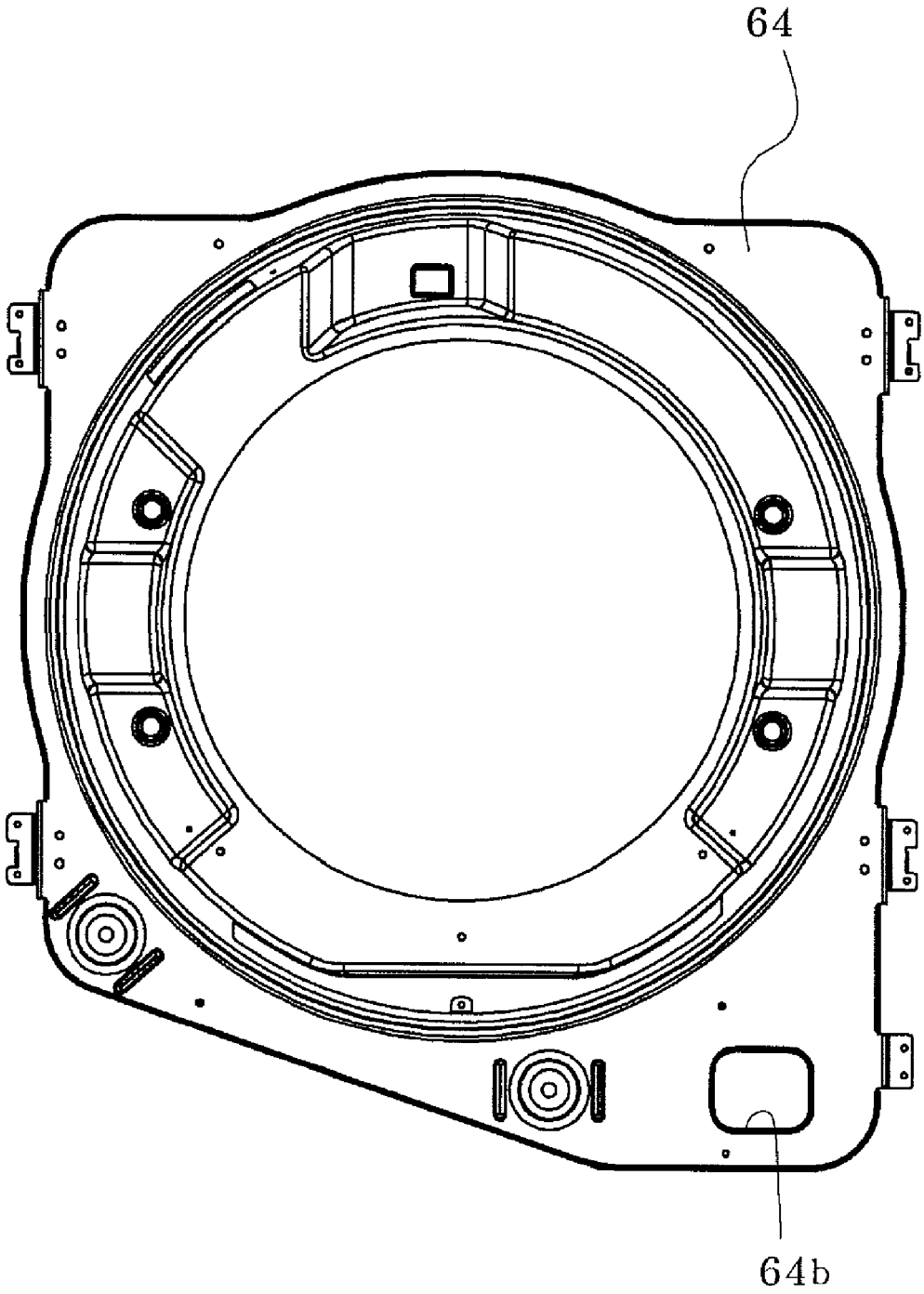
FIG. 9 is a front view illustrating a front panel of the dryer in accordance with an embodiment of the present invention.

Also, FIG. 6 is a plan view illustrating an intake flow path of the dryer in accordance with an embodiment of the present invention; FIG. 7 is a side sectional view illustrating a circulation flow path of the dryer in accordance with an embodiment of the present invention; FIG. 8 is a plan view illustrating an exhaust flow path of the dryer in accordance with an embodiment of the present invention; and FIG. 9 is a front view illustrating a front panel of the dryer in accordance with an embodiment of the present invention.

Referring to FIGS. 3 to 9, a dryer in accordance with an embodiment of the present invention includes a cabinet 50 which has a predetermined space therein and is provided with an opening and discharge port 54, a drum 60 which rotatably mounted in an inside of the cabinet 50 to accommodate the laundries to be dried, a lifter 60*a* which is mounted on an inner wall of the drum 60 to lift up the laundries to be dried, an intake duct 70 which guides air inside the cabinet 50 to the inside of the drum 60, a gas heater 100 installed in the intake duct 70, an exhaust fan 82 (refer to FIG. 8) which is provided between the drum 60 and the discharge port 54, an exhaust duct 80 which is provided between the exhaust fan 82 and the discharge port 54 and a driving motor 90 (refer to FIG. 8) which is connected with a rotation shaft of the exhaust fan 82.

When power is applied to the driving motor 90, the exhaust fan 82 is rotated to circulate air and the air flowed in the inside of the cabinet 50 is changed high temperature air while passing the gas heater 100.

The air is supplied to the inside of the drum 60 along the intake duct 70 and in brought into contact with the laundries to perform drying operation or sterilizing operation.

After that, the air exhausted by the exhaust fan 82 is flowed along the exhaust duct 80 and exhausted to an outside through the discharge port 54 of the cabinet 50, thereby completing the circulation of the air.

The drum 60 is formed in a cylindrical shape with opened front portion, which corresponds to the opening, and rear portion, and is rotatably mounted to a support panel 62 which is formed with a through hole part 62*a*.

The support panel 62 is mounted at a rear side of the cabinet 50 to rotatably support the drum 60. Also, the through hole part 62*a* of the support panel 62 is communicated with the intake duct 70.

A front panel 64 is installed between the front end portion of the drum 60 and the opening of the cabinet 50 and is formed with an exhaust hole 64*a* at a lower end portion thereof.

The exhaust hole 64*a* is connected with a connection duct 84 which is extended toward the exhaust fan 82, and a housing (not shown) for housing the exhaust fan 82 therein is placed between the connection duct 84 and the exhaust duct 80.

The intake duct 70 is extended from the gas heater 100 to the through hole part 62*a*. Therefore, the air is changed to air having a temperature higher than a predetermined temperature while passing through the gas heater 100 and flowed along the intake duct 70 to be supplied to the inside of the drum 60 through the through hole part 62*a*.

At this time, since a contact area between the high temperature air and the laundries to be dried is increased as the drum 60 connected with the driving motor 90 by a belt (not shown) is rotated, the efficiency of the drying and sterilizing operation is enhanced.

The gas heater 100 includes a gas pipe 130 for supplying gas, a valve 150 for controlling supply and cutoff of the gas and an amount of the supplied gas, a nozzle 140 provided at a side of the valve 150, a mixing pipe 120 placed corresponding to the nozzle 140 to mix the gas and the air, an ignition plug 170 mounted on the mixing pipe 120 to generate sparks, a guide duct 110 placed at an outside of the mixing pipe 120 to guide the heated air, a bracket 160 for mounting the mixing pipe 120 to the cabinet 50, and a flame holder 180 placed in the mixing pipe 120 to prevent that a flame produced by the ignition plug 170 becomes larger than a predetermined size.

As the valve 150 is opened, the gas is supplied to the mixing pipe 120 along the gas pipe 130. Then, the gas is mixed with the air in the cabinet 50 and injected to the outside of the mixing pipe 120 and the flame is produced by the sparks generated in the ignition plug 170.

Size and production position of the flame are controlled by the flame holder 180, so that the flame is placed inside the guide duct 110. The air flowed in along the guide duct 110 is changed to a hot wind with a high temperature while passing through the flame.

The bracket 160 has a grove part 160*a* which is formed at an upper face thereof and in which the mixing pipe 120 is seated, and a fixing face 160*b* which is formed at a rear side (left side in FIG. 5) and on which the ignition plug 170 is mounted.

The valve 150 is mounted on the bracket 160 by a fixing piece 152 and the fastening part 162 is provided at a front side (right side in FIG. 5) of the bracket 160 to be coupled to the fixing piece 152.

Upon installation or replacement of the valve 150, assembling of the valve 150 is completed by fixing the valve 150 to the fixing piece 152 and coupling the fixing piece 152 to the fastening part 162 formed at the front side of the bracket 160.

The fixing piece 152 is a bended panel having a '⊓'shape and has an upper face on which the valve 150 is mounted and a side face which comes in close contact with the fastening part 162 and is formed with through hole parts 154.

As a fastening member passes through the through hole part 154 to be fastened to the fastening hole part 164 of the fastening part 162, the valve 150 is mounted on the bracket 160 through the fixing piece 152.

The fastening part 162 is provided with projections 166 and the fixing piece 152 is provided with hole parts 156 corresponding to the projections 166. Since the fixing piece 152 is temporarily fastened to the bracket 160 as the hole parts 156 are seatedly inserted on the projections 166, a worker can, thereafter, firmly couple the fixing piece 152 to the bracket 160 using the fastening members.

At this time, the valve 150 coupled to the bracket 160 by the fixing piece 152 can be approached from the front side of the dryer through a gap between the front panel 64 and a lower face of the cabinet 50.

Therefore, upon control, repair or replacement for the valve 150, it is possible to perform the operation using the gap and thus omit the operation of separating the front panel 64 from the cabinet 50 as has been conventionally done.

Also, a service hole part 64*b* corresponding to the position at which the valve is installed is formed at a lower part of the front panel 64 and it is thus possible to approach the valve 150 without through the gap between the front panel 64 and the lower face of the cabinet 50.

Therefore, it is possible to conveniently select the gap between the front panel 64 and the lower face of the cabinet 50 or the service hole part 64*b* upon the control, repair or replacement for the valve 150.

The mixing pipe 120 is provided with a mixing part 124. Since the mixing part 124 includes an opening which is larger than the nozzle 140, the gas injected from the nozzle 140 and air flowed in are mixed with each other in the mixing part 124.

The mixing part 124 is formed in such a manner that an end of the mixing part 120 is extended and has a hollow cylindrical shape with an opening formed at the end thereof corresponding to the nozzle 140.

Hereinafter, operation of the gas heater and the dryer having the gas heater in accordance with an embodiment of the present invention will be described.

When a user manipulates an operation button (not shown), the power is applied to the driving motor 90 to rotate the exhaust fan 82 and the drum 60.

By the driving of the exhaust fan 82, the air flowed in the inside of the cabinet 50 is moved to an upside of the cabinet 50 along the intake duct 70 vertically formed on a rear face of the cabinet 50.

When the valve 150 is opened, gas supplying along the gas pipe 130 is begun and the supplied gas passes through the nozzle 140 to be injected to the inside of the mixing pipe 120.

The gas is primarily mixed with the air flowed in through the nozzle 140 and secondarily mixed with the air flowed in through the space between the mixing pipe 120 and the nozzle 140.

The mixture of the air and gas is injected through the mixing pipe 120 and a flame is produced by operation of the ignition plug 170.

At this time, since the injected mixture collides with the flame to form a vortex, the flame is laterally spread in the vicinity of the flame holder 180.

The air flowed in the inside of the intake duct 70 along the guide duct 110 is heated to dry air with a high temperature higher than a predetermined temperature.

After that, the air flowed in the inside of the drum 60 through the through hole part 62*a* is swirled to dry the laundries to be dried.

the front panel 64 placed between the front end portion of the drum 60 and the opening of the cabinet 50 and is formed with an exhaust hole 64*a* and the air which finished the dry operation is exhausted to the outside of the drum 60 through the exhaust hole 64*a*.

After that, the air is flowed to the exhaust fan 82 through the connection duct 84 communicated with the exhaust hole 64*a*, then move from the exhaust fan 82 along the exhaust duct 80 and exhausted to the outside of the cabinet 50 through the discharge port 54.

The following is operation of the gas heater 100. The valve 150 is opened with the beginning of the dry operation and the gas injected to the mixing pipe 120 through the nozzle 140 is primarily mixed with the air flowed in through the nozzle 140.

After that, the secondary mixing is performed as the air flowed in the mixing part 124 of the mixing pipe 120 and the primarily mixed mixture are mixed.

The mixture is injected to the outside of the mixing pipe 120 and the flame is produced by the ignition plug to supply thermal energy to the air supplied to the intake duct 70.

Also, this flame is gathered in a middle of the guide duct 110 by the flame holder 180 to prevent the deformation or damage of the mixing pipe 120 and the intake duct 70.

Meanwhile, upon control, repair or replacement for the valve 150, it is possible to perform the operation since the valve 150 can be approached through the gap between the front panel 64 and the lower face of the cabinet 50 or the service hole part 64*b* by separating a front face of the cabinet 50.

Figure 10:
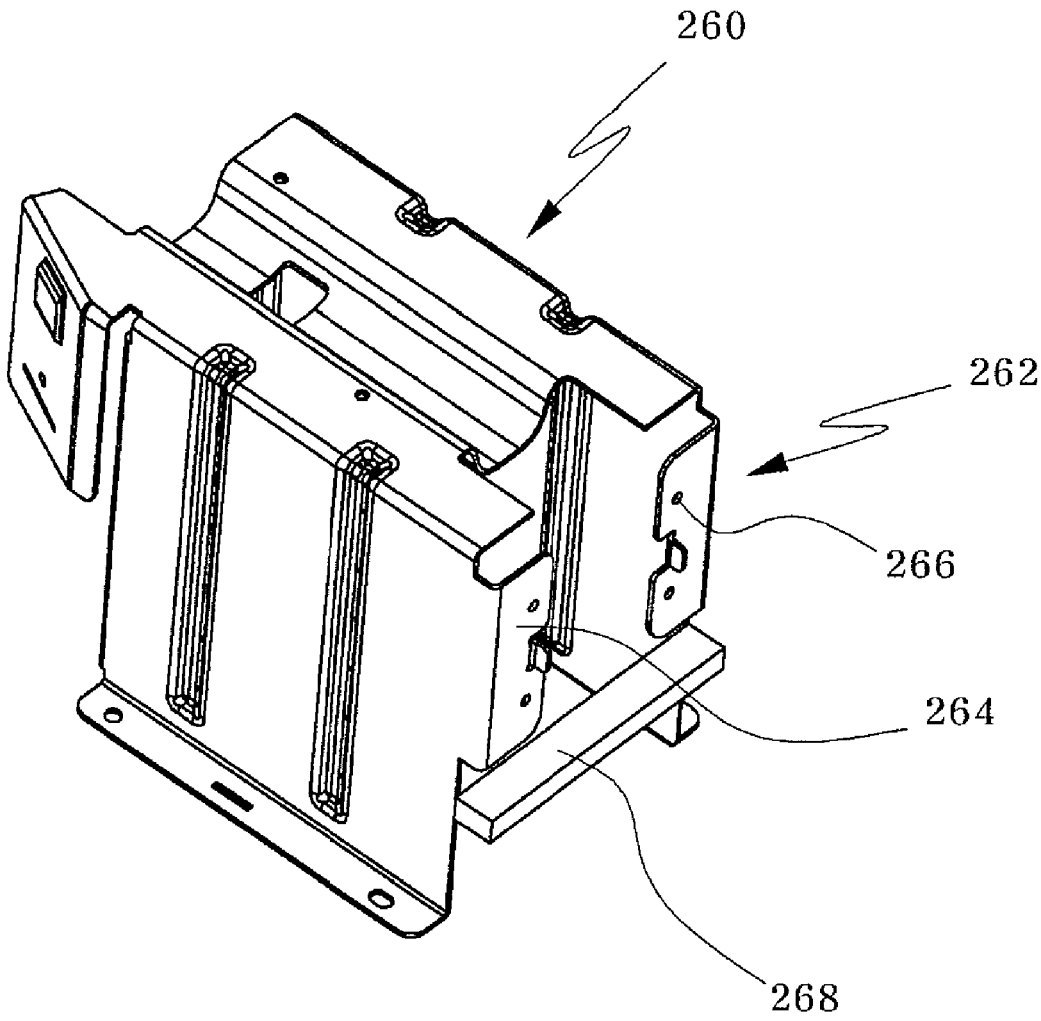
FIG. 10 is a perspective view illustrating another example of the bracket.

FIG. 10 is a perspective view illustrating another example of the bracket.

Referring to FIG. 10, another example of the bracket 260 of the dryer is characterized by a fastening part 262 when compared with the bracket in the above described embodiment. This fastening part 262 includes a guide 264 in which the fixing piece 152 (refer to FIG. 4) is inserted and a support piece 268 which supports the fixing piece 152. The guide 264 is formed with fastening hole parts 266 which correspond to the through hole parts 154 of the fixing piece 152.

The guide 264 is formed in a '⊏'shape and is provided at both ends of the front side (right side of FIG. 10) of the bracket 260, and the fixing piece 152 is thus temporarily fastened to the bracket 160 as the fixing piece 152 is slid between a pair of the guides 264.

Also, the support piece 268 is provided at a lower side of the guide 264 to support the fixing piece 152 inserted along the guides 264 so that the fixing piece 152 is not slid any more by the support piece 268.

After the fixing piece 152 is temporarily fastened to the bracket 260, a worker can firmly couple the fixing piece 152 to the bracket 260 using the fastening members.

Although the present invention has been described with reference to the embodiments shown in the drawings, it should be understood that these embodiments are provided for illustrative purpose and that various equivalent modifications and alterations will be apparent to those skilled in the art without departing from the scope and spirit of this invention.

In addition, although the present invention has been described with reference to the dryer as specifically described herein, it should be noted that the dryer has been illustrated by way of example, and that the present invention may be applied to other product, without being limited to the dryer in its application.

Therefore, the scope and spirit of the invention is limited only by the claims set forth herein as follows.

What is claimed is:

1. A dryer, comprising:

a cabinet;

a drum rotatably mounted inside the cabinet;

a front panel provided between the cabinet and the drum;

a valve provided inside the cabinet to control supply and cutoff of gas and an amount of the supplied gas;

a fixing piece for mounting the valve on one side thereof; and a bracket coupled to the other side of the fixing piece, wherein the front panel is provided with a service hole part, and the service hole part is formed at a location corresponding to a position at which the valve is installed.

2. The dryer of claim 1, wherein the bracket is provided with a projection which corresponds to a through hole part of the fixing piece.

3. The dryer of claim 1, wherein the fixing part includes a bended panel having a '¬'shape.

4. The dryer of claim 3, wherein the valve is mounted on an upper face of the fixing piece and the bracket is coupled to a side face of the fixing piece.

5. The dryer of claim 4, wherein the side face of the fixing piece is formed with a through hole part and the bracket is formed with a fastening hole part which corresponds to the through hole part.

6. A dryer, comprising:

a cabinet;

a drum rotatably mounted inside the cabinet;

a front panel provided between the cabinet and the drum;

a valve provided inside the cabinet to control supply and cutoff of gas and an amount of the supplied gas;

a fixing piece for mounting the valve on one side thereof; and a bracket slidingly mounted to the other side of the fixing piece, wherein the front panel is provided with a service hole part, and the service hole part is formed at a location corresponding to a position at which the valve is installed.

7. The dryer of claim 6, wherein the bracket is provided with a guide into which the fixing piece is slidingly inserted; and a support piece disposed at a lower side of the guide to support the fixing piece.

8. The dryer of claim 6, wherein the fixing part includes a bended panel having a '¬'shape.

9. The dryer of claim 8, wherein the valve is mounted on an upper face of the fixing piece and the bracket is coupled to a side face of the fixing piece.

10. The dryer of claim 9, wherein the side face of the fixing piece is formed with a through hole part and the bracket is formed with a fastening hole part which corresponds to the through hole part.

* * * * *